US009490536B2

(12) United States Patent
Lee et al.

(10) Patent No.: US 9,490,536 B2
(45) Date of Patent: Nov. 8, 2016

(54) MULTI-BAND ANTENNA

(71) Applicant: Amazon Technologies, Inc., Reno, NV (US)

(72) Inventors: Cheng-Jung Lee, San Jose, CA (US); Tao Zhou, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 374 days.

(21) Appl. No.: 14/108,564

(22) Filed: Dec. 17, 2013

(65) Prior Publication Data

US 2015/0171518 A1 Jun. 18, 2015

(51) Int. Cl.

| | |
|---|---|
| ***H01Q 1/24*** | (2006.01) |
| ***H01Q 5/00*** | (2015.01) |
| ***H01Q 5/378*** | (2015.01) |
| ***H01Q 9/42*** | (2006.01) |

(52) U.S. Cl.

CPC ..... *H01Q 5/378* (2015.01); *H01Q 9/42* (2013.01)

(58) Field of Classification Search

CPC ..... H01Q 5/378; H01Q 9/42

See application file for complete search history.

(56) References Cited

U.S. PATENT DOCUMENTS

| | | | | |
|---|---|---|---|---|
| 2005/0259031 | A1 | 11/2005 | Sanz et al. | |
| 2006/0119526 | A1 | 6/2006 | Gilbert et al. | |
| 2009/0015507 | A1* | 1/2009 | Hong et al. | H01Q 9/42 343/873 |
| 2012/0313830 | A1 | 12/2012 | Lee | |
| 2013/0057442 | A1 | 3/2013 | Brown et al. | |

OTHER PUBLICATIONS

International Search report for PCT/US14/69440.

* cited by examiner

*Primary Examiner* — Hoang V Nguyen
*Assistant Examiner* — Michael Bouizza
(74) *Attorney, Agent, or Firm* — Seyfarth Shaw LLP; Ilan N. Barzilay; David A. Klein

(57) ABSTRACT

A multiband antenna for mobile devices that includes both energized and parasitically-coupled resonant elements. An energized element is fed radio frequency energy and resonates at a first frequency. A first parasitic element, arranged on a same surface as the energized element, is parasitically coupled to the energized element and resonates with at least a second frequency. A second parasitic element, arranged on a surface opposite the energized element resonates at a third frequency.

25 Claims, 13 Drawing Sheets

MULTI-BAND ANTENNA

BACKGROUND

A large and growing population of users is enjoying entertainment through the consumption of digital media, such as music, movies, images, electronic books, and so on. The users employ various electronic devices to consume such media. Among these electronic devices (referred to herein as "user equipment" or "UEs") are electronic book readers, cellular telephones, personal digital assistants (PDAs), portable media players, tablet computers, netbooks, laptops, and the like. Providing a wide and increasing variety of applications and services, these electronic devices each include at least one antenna to support wireless communications with a communications infrastructure.

Mobile devices may include antennae capable of communication across multiple frequency bands. A single "multi-band" antenna may support communications on multiple frequency bands. In legacy "third generation" (3G) devices, multi-band antenna may support two distinct ranges of frequencies, providing one resonant mode in a lower frequency band and one resonant mode in a higher frequency band. Application services offered by 3G devices include voice telephony, mobile Internet access, video calls and mobile TV. Some of these services may be supported on some of the frequency bands available to the device but not on others.

"Long Term Evolution" (LTE) (sometimes marketed as "4G LTE") is a communication standard bridging between legacy 3G communications and higher-speed "fourth generation" (4G) services. "LTE Advanced" (LTE-A) is an enhancement of LTE and supports "True 4G" communications. Both LTE and LTE-A have been standardized by the 3rd Generation Partnership Project (3GPP). In general, increasing the data rate provided to the services over that offered by 3G requires increasing the bandwidth available to the service. The performance of the higher speed services offered by 4G/LTE may be hampered by the limited ability to operate in available bands and the relative narrowness of the range of frequencies readily accessible within a band as afforded by conventional multi-band antennae that were used with 3G.

Past solutions to expand the bandwidth available to 4G devices have resulted in increasing the size of multi-band antennae, such as adding active tuning elements to extend bandwidth, or using separate antennae to achieve cover additional frequency bands. In view of the limited physical space available in mobile devices such as cellular telephones and tablet computers, the need to optimize space utilization, and the general trend for devices to get smaller—rather than larger—with each generation, increasing the space dedicated to antennae necessitates design trade-offs (e.g., reducing the size of the battery) that may result in improving one feature at the expense of another.

BRIEF DESCRIPTION OF DRAWINGS

For a more complete understanding of the present disclosure, reference is now made to the following description taken in conjunction with the accompanying drawings. While several of the figures approximate proportions of various structures, they are not drawn to scale unless otherwise noted.

DETAILED DESCRIPTION

Figure 1:
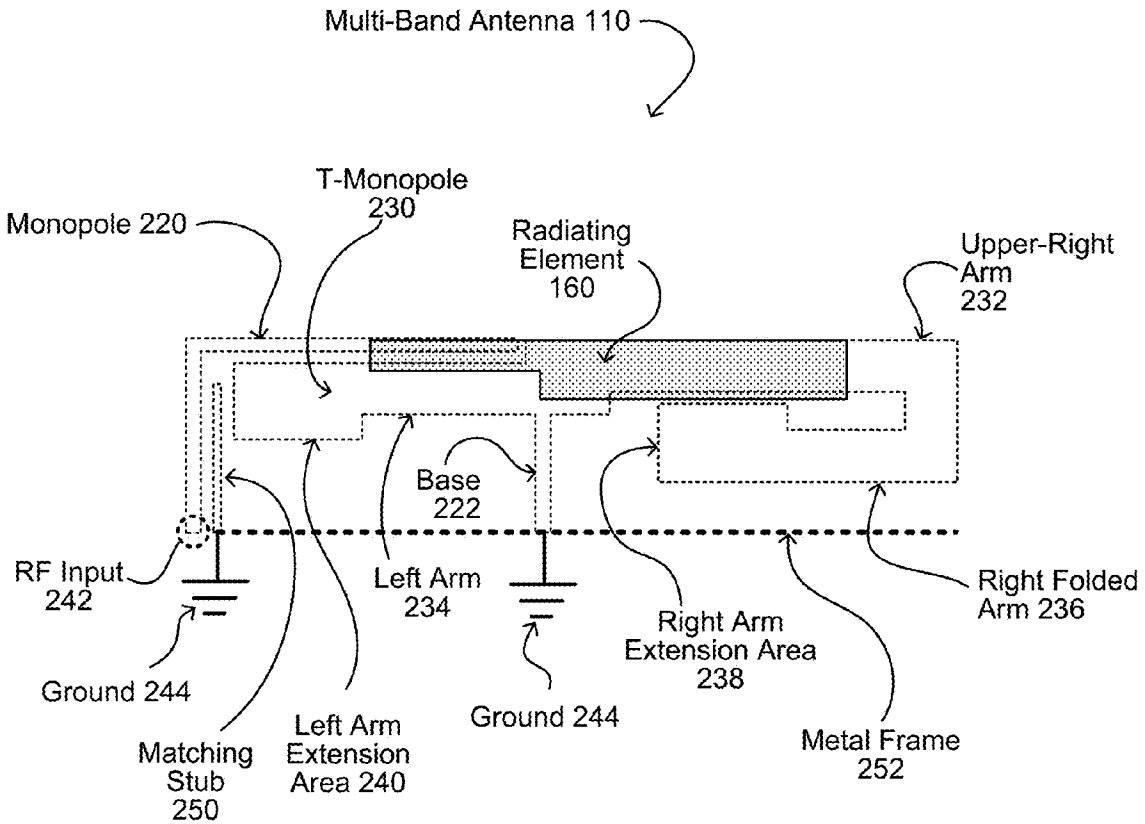
FIG. 1 illustrates a schematic outline for a multi-band antenna including both RF (radio frequency) current-fed and parasitically-coupled resonance elements, including an opposing parasitic element with no electrical connection to the current-fed and parasitically-coupled resonance elements.

By adding an opposing parasitic element to current-fed and parasitically-coupled resonance elements of an antenna, as shown for example in FIG. 1, additional frequency bands may be supported in approximately the same physical space as the antenna without the opposing element. In addition, by adding a conductive matching stub tied to ground between the current-fed and parasitically-coupled resonance elements, impedance matching may be improved. FIG. 1 will be discussed further below after first examining the antenna with just the conductive matching stub added.

Figure 2:
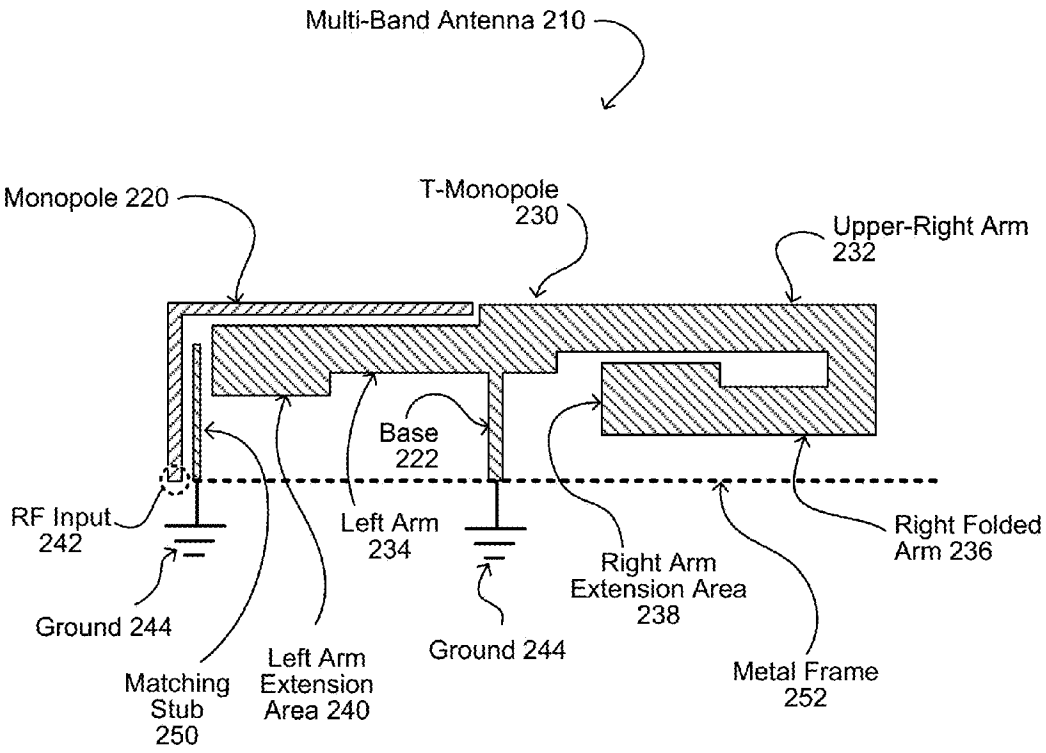
FIG. 2 illustrates a schematic outline for a multi-band antenna including both RF (radio frequency) current-fed and parasitically-coupled resonance elements similar to that in FIG. 1, but omitting the opposing parasitic element.

FIG. 2 illustrates a schematic outline for a compact multi-band antenna 210 including both energized and parasitically-coupled resonant elements, along with the conductive matching stub 250. Operating bandwidth is expanded by incorporating structures to support a plurality of different resonant frequency bands.

Parasitic coupling may be coupling that is resistive, capacitive, inductive, or some combination thereof. In electrical circuits, parasitic coupling is an effect that exists between the parts of an electronic component or circuit because of their proximity to each other. When two conductors at are close to one another, they are affected by each others' electric field. A change in voltage in one element generates an opposing charge (i.e., current) in a nearby capacitively-coupled parasitic element. Similarly, a change in current flow in one element generates an opposing potential (i.e., voltage) in a nearby inductively-coupled parasitic element (even though the parasitic element is not part of a path through which the source current that induced the voltage actually flows).

The antenna 210 comprises an monopole 220 energized by applied radio frequency (RF) energy and a T-monopole 230 that is parasitically coupled to the RF-fed monopole 220. The RF energy is applied to the monopole 220 at the RF input feed 242. The T-monopole 230 is electrically connected to ground 244 at a ground terminal at an end of a base 222 of the parasitic structure. As a parasitic element, no RF energy is directly applied or fed into the T-monopole 230. The T-monopole 230 is capacitively coupled to the monopole 220, whereby RF energy from the monopole 220 produces one or more resonant frequencies in the T-monopole. In particular, the RF-fed monopole 220 radiates electromagnetic energy, which produces an electrical current in the parasitically-coupled T-monopole 230. This current creates one or more resonances in the T-monopole 230, thereby causing the T-monopole to radiate electromagnetic energy in one or more resonant frequency bands.

The monopole 220 and T-monopole 230 are physically separated by a gap. The relative magnitude of the current generated in the T-monopole 230 depends in part upon the width of the gap and the dimensions of the coincident portions of the monopole 220 and the T-monopole 230. The efficiency of the capacitive coupling between the monopole 220 and the T-monopole 230 is promoted by aligning the coincident portions so that the current flow produced in the parasitic element is down a length of the T-monopole 230, creating resonating standing wave(s).

The resonant frequencies produced by the RF energy (whether fed or generated by parasitic coupling) in each of the monopole 220 and T-monopole 230 are also based on the dimensions of these structures. In particular, setting the length of an element is a significant factor for setting the resonant frequency or range of frequencies that will be generated in that element. In comparison, the width is a significant factor for setting and matching the impedance of the elements to maximize the power transfer and reduce the energy lost to reflections not contributing to the resonances at the desired frequencies. As is generally understood in field of antenna design, the factors of total length and width are dependent on one another.

Resonance phenomena occur with various types of vibrations or waves. Herein, applied or parasitically-generated electromagnetic (EM) radio frequency (RF) energy creates oscillations in an antenna element, with resonance creating one or more "standing waves." The resonant structure is designed to combine added EM energy with energy reflected back down the structure to form a stationary RF wave where the EM peaks and troughs maintain a constant position. The frequency of the standing wave is a center frequency of the resonant mode.

In the example structure in FIG. 2, four resonant modes may be generated, with each resonant mode having a different center frequency. A first resonant mode may be generated in an upper-right arm 232 extending from a first side of the base 222. In the upper-right arm 232, this first resonant mode may be, for example, a resonance around 700 MHz in a "low" 4G band. The left arm 234, which extends out from a second side of the base 222 (opposite the first side), provides a second resonant mode. In the left arm 234, this second resonant mode may be, for example, around 850 MHz in another "low" 4G band.

A right folded arm 236 extends from a distal end of the upper-right arm 232, extending back towards the first side of the base 222, providing a third resonant mode. The third resonant mode may be, for example, around 1860 MHz in a "high" 4G band. The monopole 220 provides a fourth resonate mode. The fourth resonant mode may be, for example, around 2110 MHz in another "high" 4G band.

As illustrate, an extension area 238 of the right arm extends from a distal end of the right folded arm 236. The extension area 238 contributes to the frequency of the third resonant mode (provided by the right folded arm 236), and is also used to tune the impedance of the T-monopole, providing impedance matching with the fourth resonant mode generated by the monopole 220.

The antenna 210 also may include a conductive matching stub 250 comprising a ground terminal at one end connected to ground 244. The conductive matching stub 250 is interposed between the monopole 220 and an extension area 240 of the left arm. The extension area 240 of the left arm extends from a distal end of the left arm 234 of the T-monopole 230 opposite the end of the left arm 234 extending from second side of the base 222. The extension area 240 contributes to the frequency of the second resonant mode (provided by the left arm 234), and in conjunction with the conductive matching stub 250, is also used to tune the impedance of the T-monopole 230, providing impedance matching with the fourth resonant mode generated by the monopole 220.

The conductive matching stub 250 is coincident (e.g., adjacent and parallel) with a length of a portion of the monopole 220, and is also coincident with a portion of the left arm extension area 240. In particular, the impedance matching provided by the conductive matching stub 250 contributes to operation in frequency bands such as those around 1700, 1800, and 1900 MHz.

While the conductive matching stub 250 and the T-monopole 230 are both connected to ground 244, ground itself may be a non-resonant structure, or at least a structure that does not appreciably contribute to resonance. As such, although the conductive matching stub 250 and the T-monopole 230 may be electrically connected via ground, the coupling of these two structure—as it contributes to resonance—is capacitive. Among other things, the ground 244 may be a metal frame 252 of the UE (e.g., UE 1300 in FIG. 13). The ground 244 may be a common system ground or one of multiple grounds of the UE 1300.

The RF input feed terminal 242 may be a feed line connector that connects the multi-band antenna 210 to a feed line (also referred to as a transmission line), which is a physical connection that carries the RF signal to and/or from the multi-band antenna 210. As used herein, elements are "connected" if there is a physical electrical connection between the elements. The feed line connector may be one of any type feed lines, including a coaxial feed line, a twin-lead line, or a waveguide. A waveguide is a hollow metallic conductor (e.g., a "pipe" with a circular or square cross-section), and the RF signal travels along the inside of the hollow metallic conductor. Other types of feed connectors may also be used. While the feed is physically connected to monopole 220, it is not physically connected to the T-monopole antenna 230, which as noted above, is parasitically coupled to the monopole antenna 220.

Figure 3:
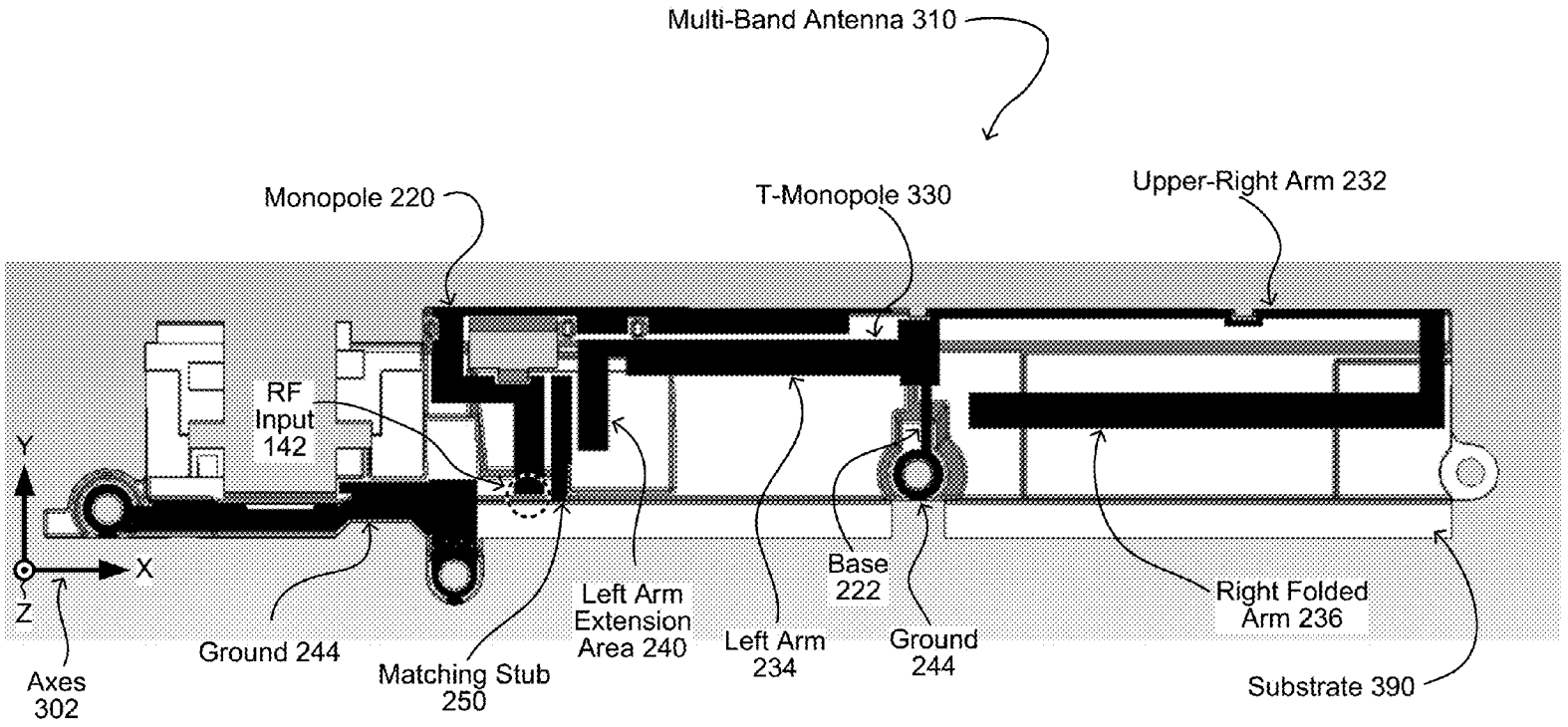
FIGS. 3 to 5 illustrate an example of an antenna based on the schematic in FIG. 1.

The multi-band antenna 210 may be disposed on a two or three-dimensional surface of an electrically non-conductive substrate such as a dielectric carrier (see, for example, three-dimensional substrate 390 in FIG. 3). Examples of non-conductive substrate include a circuit board, such as a printed circuit board (PCB), a non-conductive plastic, glass, a metal-doped laser-activated thermoplastic (as may be used with laser direct structuring (LDS)), etc. Within the UE 1300, antennae are positioned so that the resonant elements do not come into contact with other electrically conductive components within the UE.

While the elements of antenna 210 may all reside in a same plane, such as on one side of a flat substrate, bendable substrates (e.g., plastic) and three-dimensional substrates (e.g., injection molded plastics, which may comprise complex structures such as stepped surfaces, varying thicknesses, cutouts, angles and strengthening ribs) may also be used, such that elements of antenna 210 may be non-planar. Portions of antenna 210 may be arranged on levels at different "heights" on the surface of the substrate carrier, such as the upper-right arm 232 and right folded arm 236 being at different non-planar levels with a "step" in height occurring at the end of antenna 210 where the right folded arm 236 folds back toward the base 222. Moreover, portions of the antenna 210 may be folded or bent to conform to a surface or available space.

Missing from the antenna 210 in FIG. 2 is an element resonant supporting upper 4G frequency bands in the range of 2.5 to 2.7 GHz (i.e., LTE Band 7). FIG. 1 illustrates a schematic outline of a multi-band antenna 110 based on the design discussed with FIG. 2, but adding an opposing parasitic element 160 on an opposite side of the substrate/carrier. The physical length of radiating element 160 is based on one-half the wavelength of the band's center frequency, such as one-half the wavelength of 2.6 GHz. There is no physical electrical connection between the radiating element 160, the monopole 220, and the T-monopole 230, with the radiating element 160 resonating due to electromagnetic coupling (i.e., capacitive parasitic coupling).

At least a portion of the radiating element 160 is opposed to a portion of the monopole 220, capacitively producing current in the radiating element 160. The efficiency of the capacitive coupling between the monopole 220 and the radiating element 160 is promoted by aligning the opposing portions so that the current flow produced in the parasitic element is down a length of the radiating element 160, creating resonating standing wave(s) in the 2.5 GHz to 2.7 GHz frequency range. Among other things, adjusting a thickness of the substrate that separates the opposing surfaces may be used to adjust the amount of parasitic coupling between the monopole 220 and the radiating element 160.

Portions of the radiating element 160 may also oppose portions of the T-monopole 230. Currents generated in the radiating element 160 by parasitic coupling to the RF-fed monopole 220 may couple back across the substrate to the T-monopole 230, and currents generated in the T-monopole 230 may couple across the substrate to the radiating element 160. However, while these parasitic-element-to-parasitic-element couplings may be a design consideration and contribute to impedance matching, these couplings may be relatively weak in comparison to the electromagnetic coupling of the RF-fed monopole 220 to the radiating element 160 and the T-monopole 230.

Figure 4:
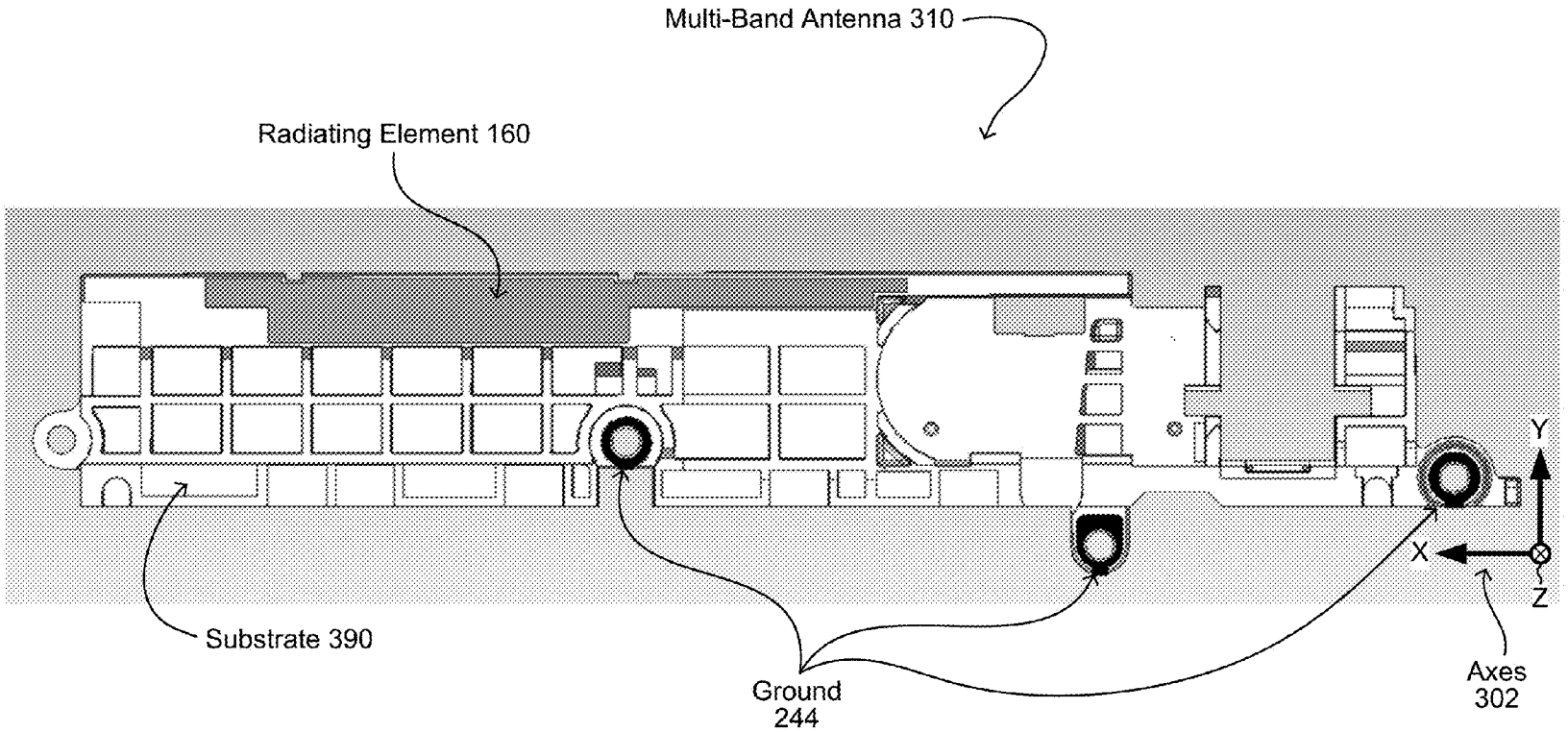
Figure 5:
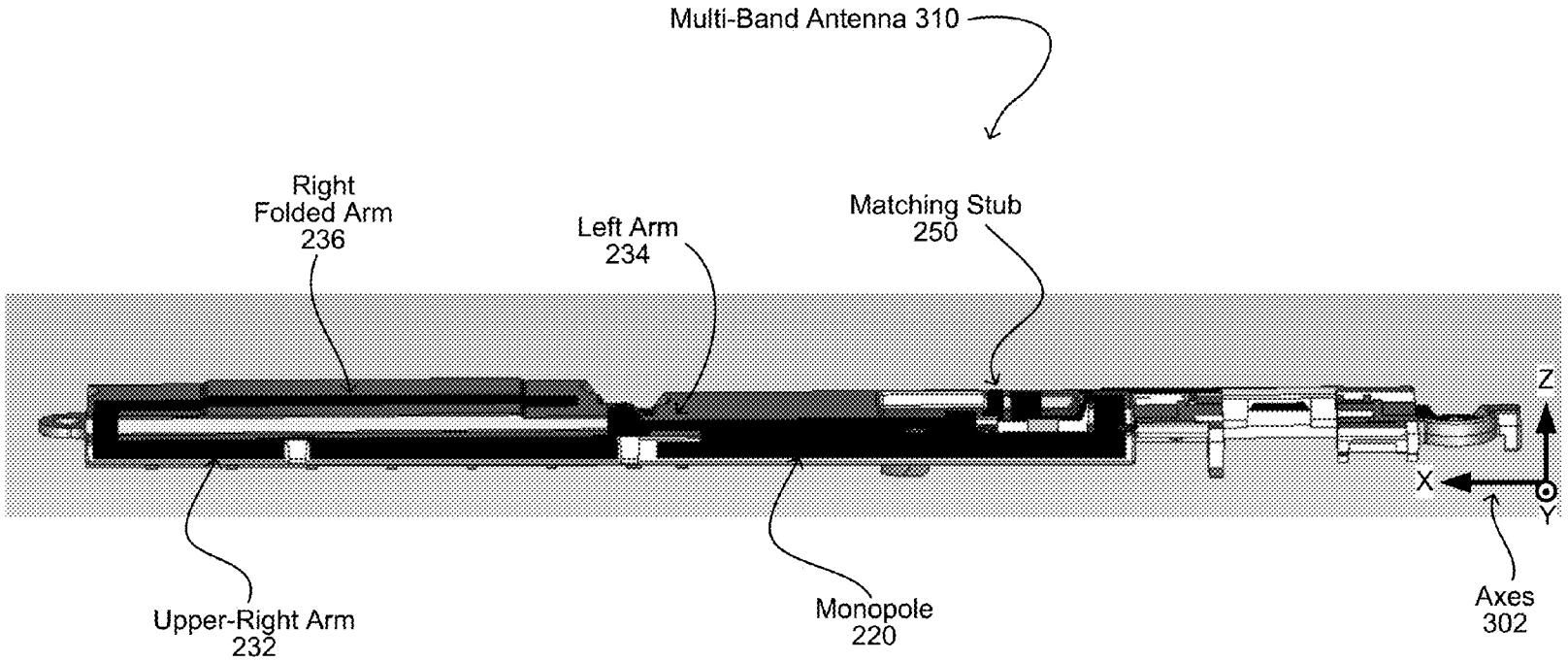

FIGS. 3 to 5 illustrate an example of an antenna 310 based on the schematic in FIG. 1, constructed on a three-dimensional carrier substrate 390. T-monopole 330 in this example is based on the T-monopole 230, but omits the right arm extension area 238. X, Y and Z axes 302 are included in these figures to provide a frame of reference between the views. As illustrated in FIG. 3, the monopole 220, a T-monopole 330 and the conductive matching stub 250 are situated on one side of a substrate 390. As illustrated in FIG. 4, the opposing parasitic radiating element 160 is located on an opposite side of the substrate 390. FIG. 5 illustrates a slightly-off angle, top-down profile view, showing (among other features) that the right folded arm 236 and the upper-right arm 232 are arranged at different heights (relative to the Z-axis) on the substrate 390.

Figure 6:
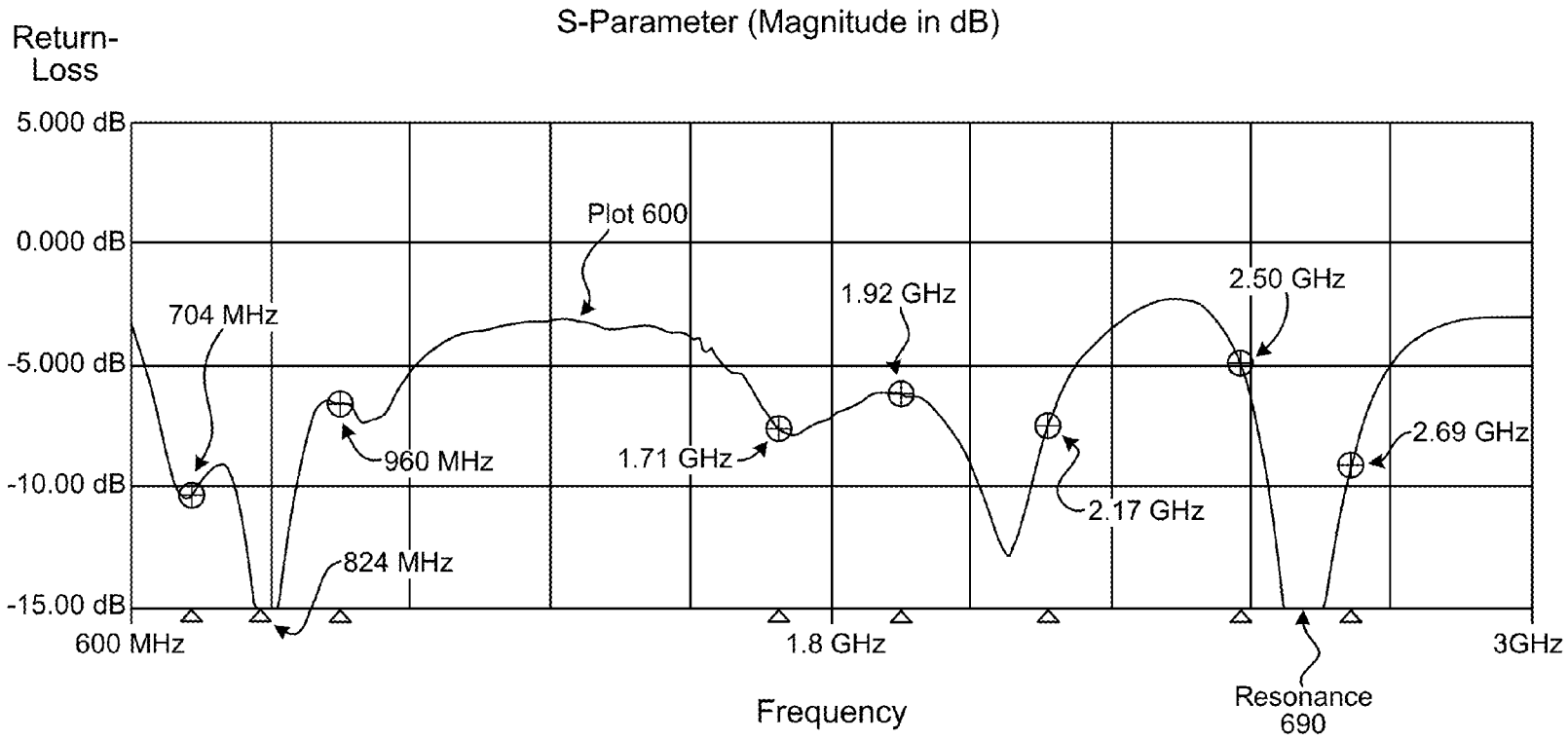
FIG. 6 is a scattering parameter (S-parameter) chart illustrating performance characteristics of an antenna including the opposing parasitic element of FIGS. 3 to 5.

FIG. 6 is a scattering-parameter (S-parameter) chart illustrating performance characteristics for the antenna 310, with the troughs in return-loss demonstrating resonance in the antenna structure. Various frequencies are identified on the plot 600 for reference. The resonance 690 in the 2.5 to 2.7 GHz range is due to the parasitic radiating element 160. Laser direct structuring (LDS) may be used to construct this example substrate 390 and antenna 310.

Figure 7:
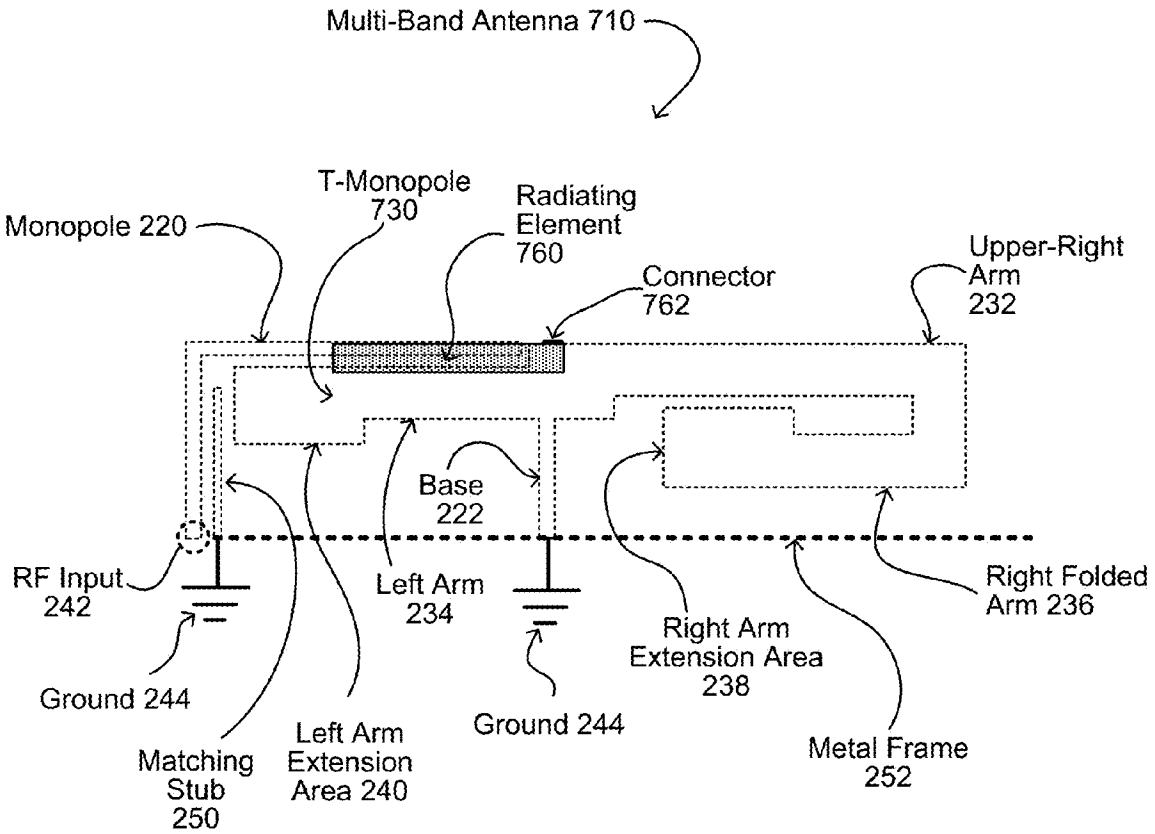
FIG. 7 illustrates a schematic outline of a multi-band antenna similar to that in FIG. 2, adding an opposing conductively-connected parasitic element.

FIG. 7 illustrates another schematic outline of a multi-band antenna 710 which also supports resonance in LTE Band 7. Antenna 710 is also based on the design discussed with FIG. 2, but adds an opposing conductively connected parasitic element 760 on an opposite side of the substrate. The physical length of radiating element 160 is based on one-quarter the wavelength of the band's center frequency, such as one-quarter the wavelength of 2.6 GHz. There is a physical connection between the radiating element 760 and the T-monopole, comprising a connector 762 connecting an end of the radiating element 760 to the T-monopole 730 proximate to the base 222 (connecting approximately between the left arm 234 and the upper right arm 232). (T-monopole 730 is structurally identical to T-monopole 230 with the exception of this connection via connector 762 to radiating element 760 spanning across a thickness of the substrate/carrier.) The radiating element 760 resonates due to electromagnetic coupling including—inductive parasitic coupling with the T-monopole 730 due to the connector 762, and capacitive parasitic coupling with the monopole 730.

At least a portion of the radiating element 760 is opposed to a portion of the monopole 220, capacitively producing current in the radiating element 760. As illustrated, at least a distal portion of the radiating element 760, opposite the end joined to the T-monopole 730 via connector 762, is capacitively coupled to the monopole 220. The efficiency of the capacitive coupling between the monopole 220 and the radiating element 760 is promoted by aligning the opposing portions so that the current flow created in the parasitic element is down a length of the radiating element 760, producing resonating standing wave(s) in the 2.5 GHz to 2.7 GHz frequency range. Among other things, adjusting a thickness of the substrate that separates the opposing surfaces may be used to adjust the amount of parasitic coupling between the monopole 220 and the radiating element 760.

Portions of the radiating element 760 may also oppose portions of the T-monopole 730. Currents generated in the radiating element 760 by parasitic coupling to the RF-fed monopole 220 may couple back across the substrate to the T-monopole 730, and currents generated in the T-monopole 730 may couple across the substrate to the radiating element 760. However, while these parasitic-element-to-parasitic-element couplings may be a design consideration and contribute to impedance matching, these couplings may be relatively weak in comparison to the electromagnetic coupling of the RF-fed monopole 220 to the radiating element 760 and the T-monopole 730.

Figure 8:
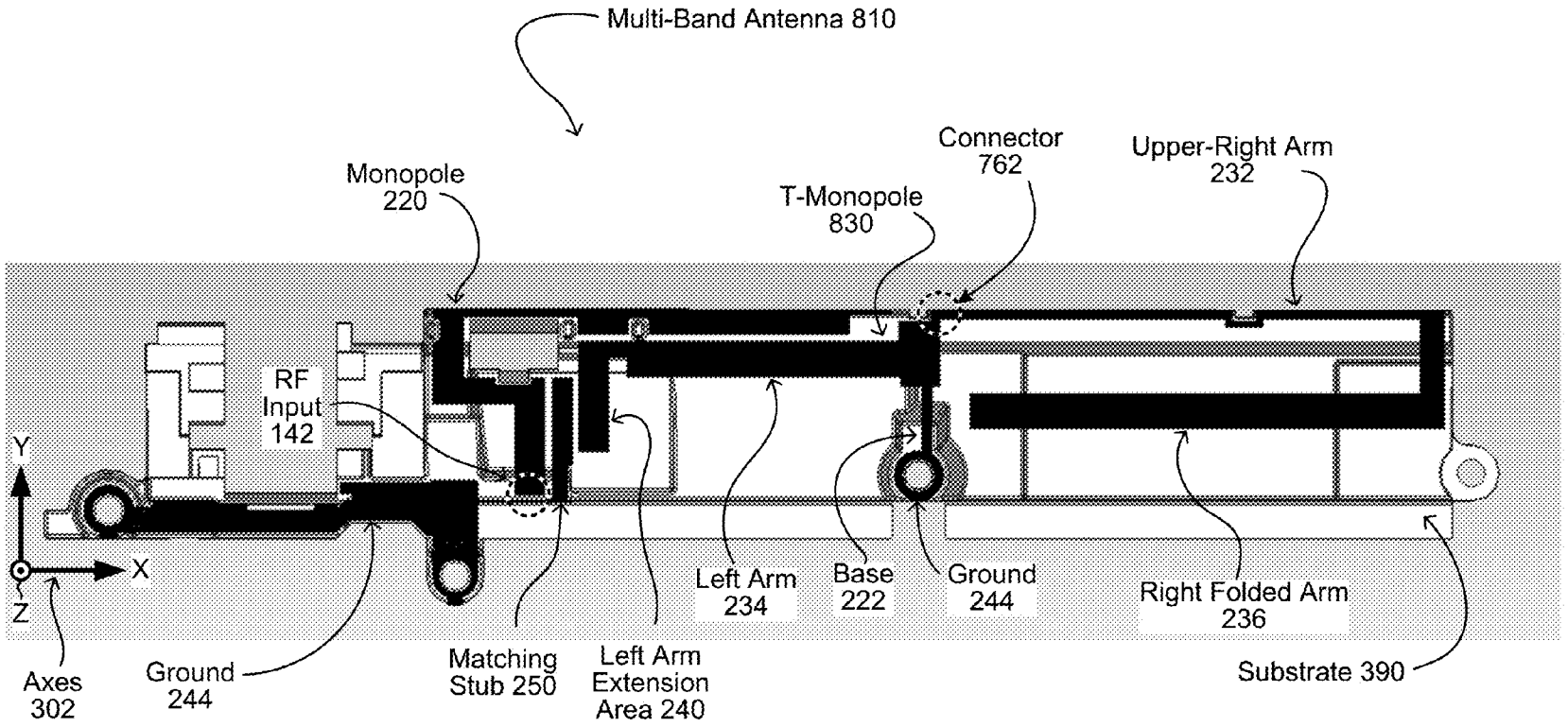
FIGS. 8 to 10 illustrate an example of an antenna based on the schematic in FIG. 7.
Figure 9:
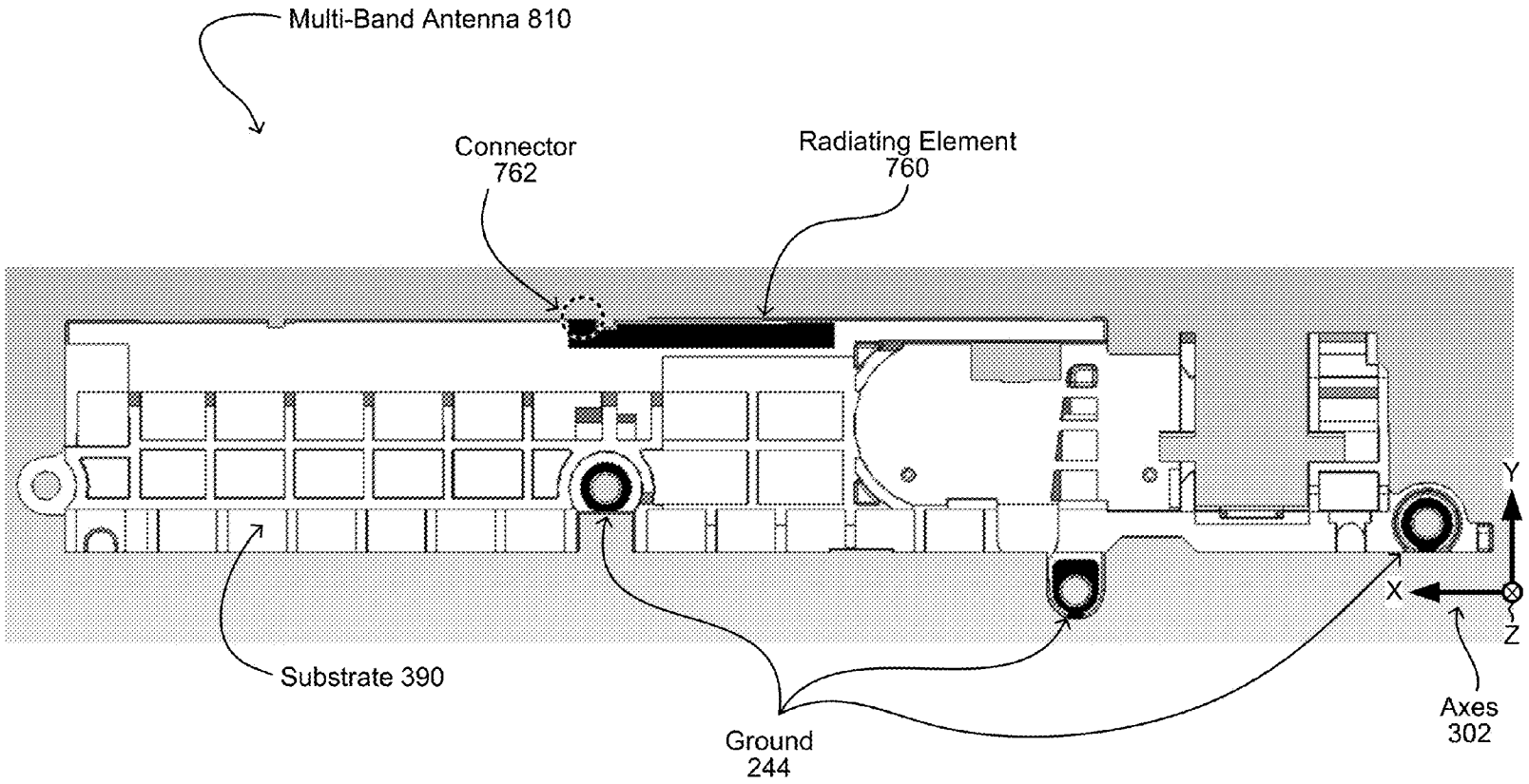
Figure 10:
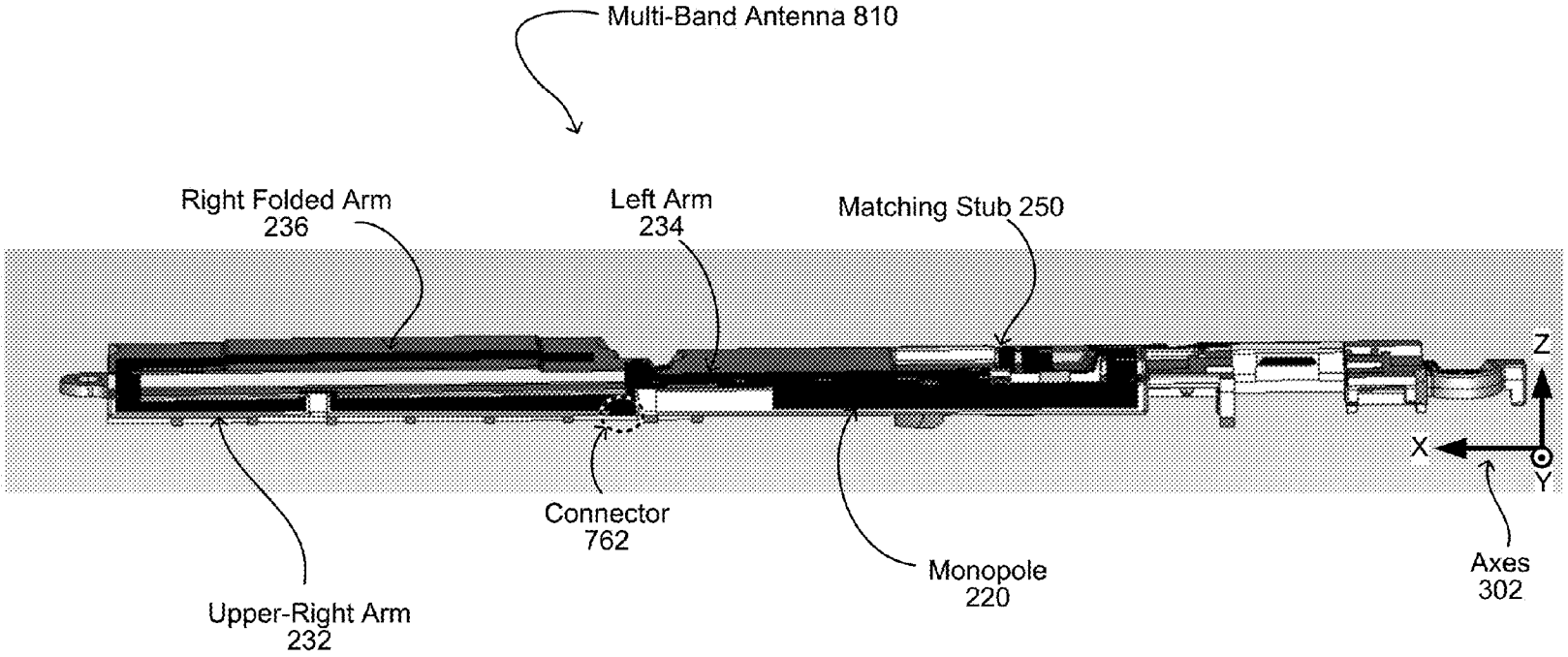

FIGS. 8 to 10 illustrate an example of an antenna 710 based on the schematic in FIG. 7, constructed on a three-dimensional carrier substrate 390. T-monopole 830 in this example is based on the T-monopole 730, but omits the right arm extension area 238. As illustrated in FIG. 8, the monopole 220, a T-monopole 830 and the conductive matching stub 250 are situated on one side of a substrate 390. As illustrated in FIG. 9, the opposing radiating element 760 is located on an opposite side of the substrate 390, conductively connected to the T-monopole 830 via connector 762 which crosses from one side of the substrate to the other, spanning a thickness along the Z-axis across an outer edge of substrate 390. FIG. 10 illustrates a slightly-off angle, top-down profile view, showing (among other features) that the right folded arm 236 and the upper-right arm 232 may be arranged at different heights (relative to the Z-axis) on the substrate 390.

Figure 11:
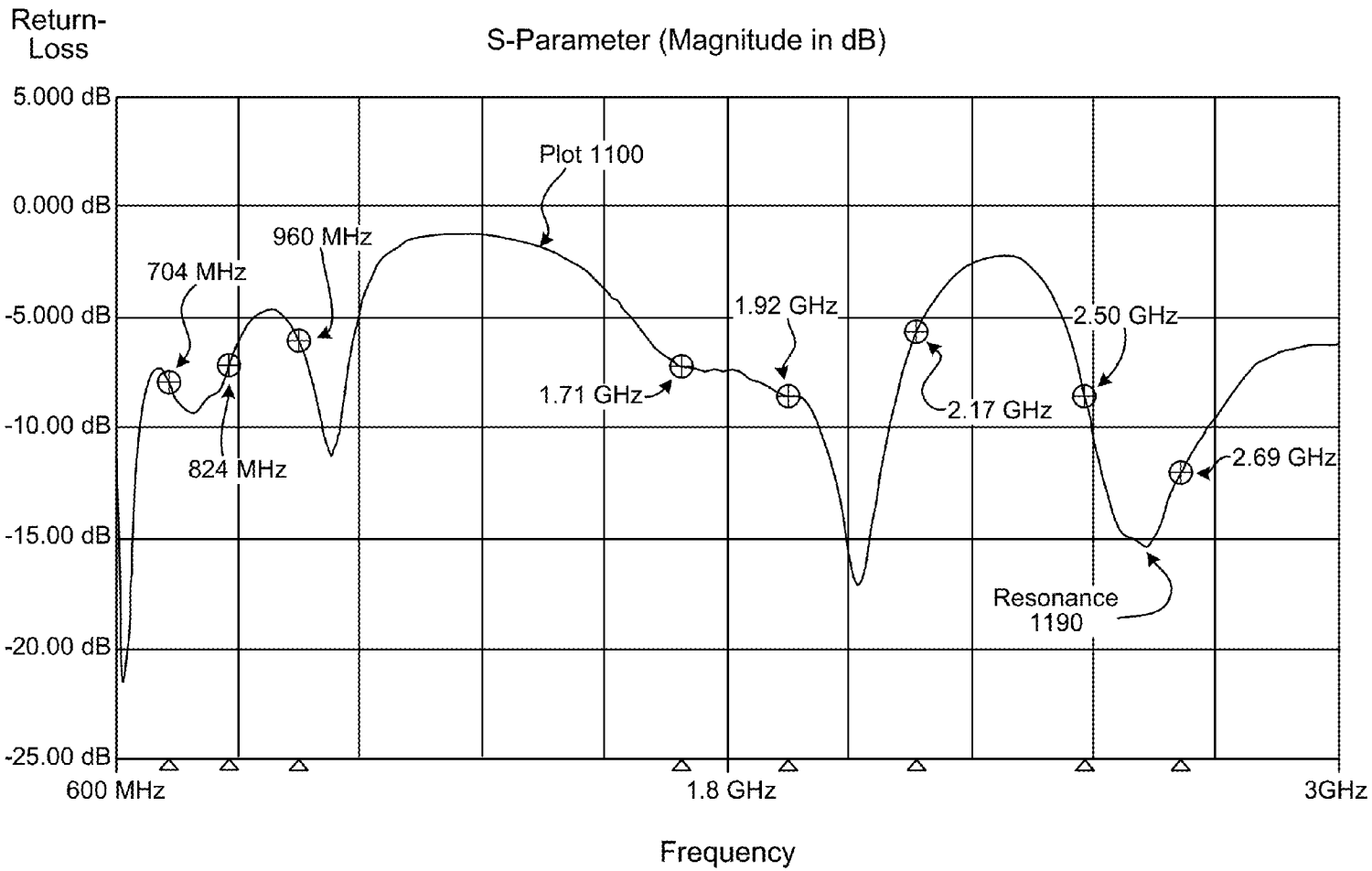
FIG. 11 is a S-parameter chart illustrating performance characteristics of an antenna including the opposing conductively-connected parasitic element of FIGS. 8 to 10.

FIG. 11 is an S-parameter chart illustrating performance characteristics for the antenna 810, with the troughs in return-loss demonstrating resonance in the antenna structure. The same assortment of frequencies identified in FIG. 6 are identified on the plot 1100 for reference. The resonance 1190 in the 2.5 to 2.7 GHz range is due to the parasitic radiating element 760. Laser direct structuring (LDS) may be used to construct this example substrate 390 and antenna 810.

Figure 12:
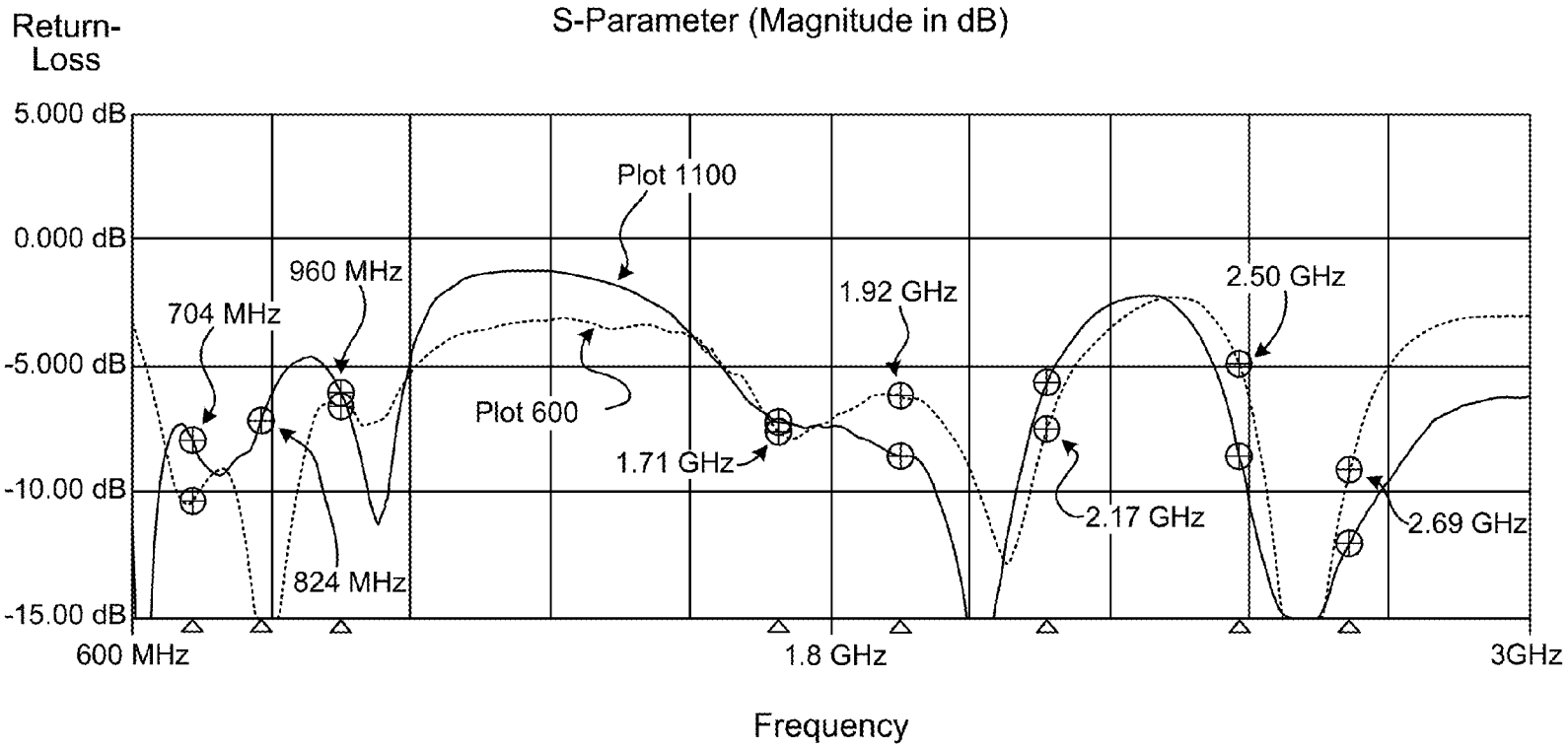
FIG. 12 is a chart combining the S-parameter data from FIGS. 6 and 11.

FIG. 12 is an S-parameter chart combining the S-parameter data from FIGS. 6 and 11. Although differences in impedance matching result in differences in performance in the lower bands, similar performance is obtained in the higher bands.

Figure 13:
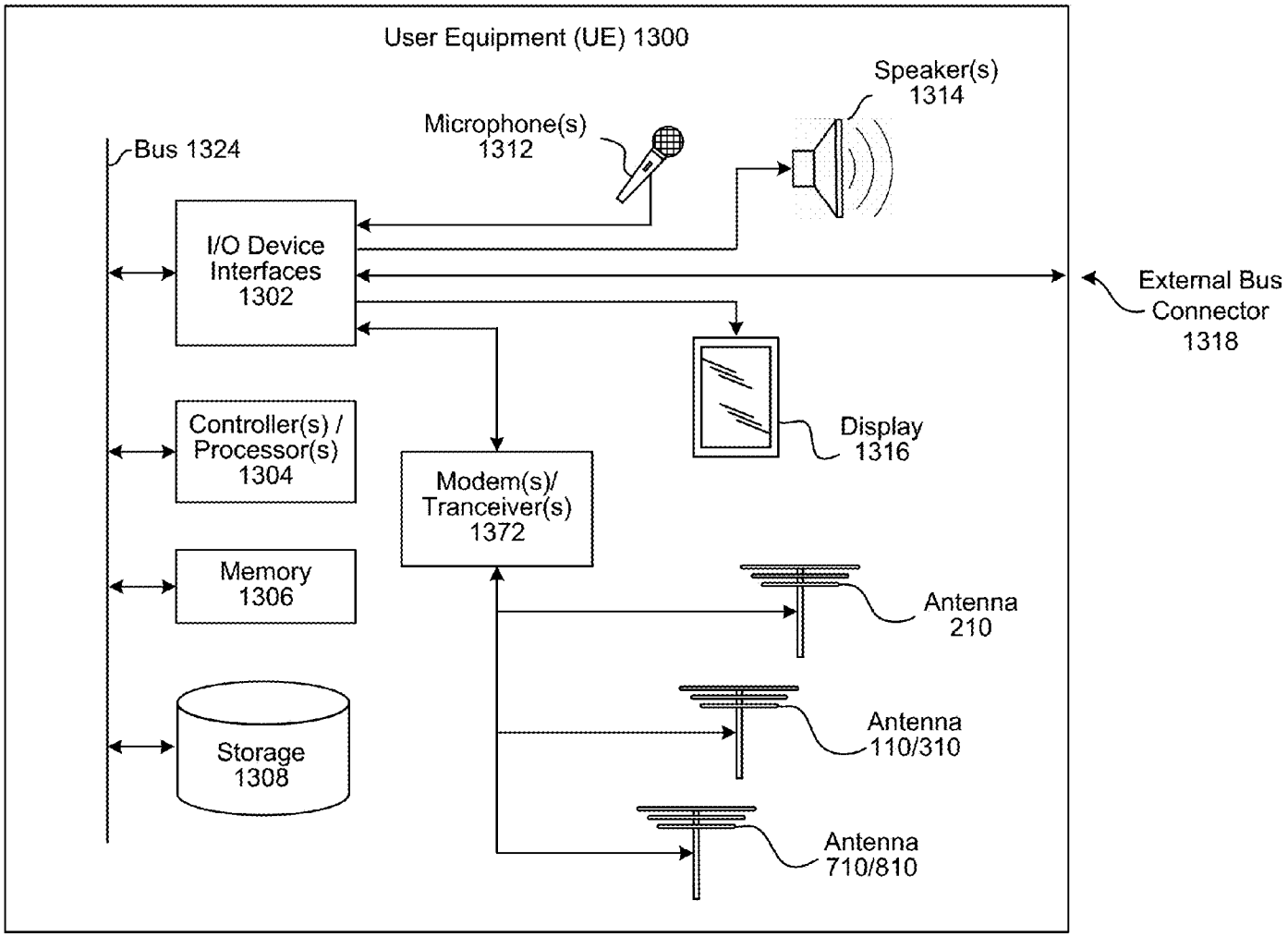
FIG. 13 is a block diagram conceptually illustrating a device including at least one of the antennae from FIGS. 2 to 5 and 7 to 10.

FIG. 13 is a block diagram of an example UE 1300 that includes one or more of antennae 110, 210, 310, 710, and 810. Various components within the UE 1300 may be connected via one or more data busses 1324, although the components may also or instead be connected to each other directly. The UE 1300 may include controller(s)/processor(s) 1304 that may each include one or more central processing units (CPUs) for processing data and computer-readable instructions, and a memory 1306 for storing data and instructions. The memory 1306 may include volatile random access memory (RAM), non-volatile read only memory (ROM), and/or other types of memory. The UE 1300 may also include a non-transitory data storage component 1308, for storing data and instructions. The data storage component 1308 may include one or more storage types such as magnetic storage, optical storage, solid-state storage, etc. The UE 1300 may also be connected to removable or external memory and/or storage (such as a removable memory card, memory key drive, networked storage, etc.) through an external bus connector 1318. Computer instructions for processing by the controller(s)/processor(s)1304 for operating the device 1300 and its various components may be executed by the controller/processor 1304 and stored in the memory 1306, storage 1308, or an external device. Alternatively, some or all of the executable instructions may be embedded in hardware or firmware in addition to or instead of software.

The UE 1300 may communicate with a variety of input/output components through input/output (I/O) device interfaces 1302. Examples of input/output components that may be included include microphone(s) 1312, speaker(s) 1314, a display 1316, and one or more modems and/or RF transceivers 1372. The I/O device interfaces 1302 may also provide access to one or more external bus connectors 1318 (e.g., a universal serial bus (USB) port), and receive data from a touch interface included with display 1316 or other user interfaces. Some or all of these components may be omitted, and additional components not included in FIG. 13 may be added.

Modem(s)/transceiver(s) 1372 are connected to the one or more of antennae 110, 210, 310, 710, and 810, and may support a variety of wireless communication protocols. For example, the modem(s)/transceiver(s) 1372 may support 4G wireless protocols such as LTE, LTE Advanced, and WiMax, 3G wireless protocols such as GSM (Global System for Mobile Communications), CDMA (code division multiple access), and WCDMA (wideband code division multiple access), short-range connectivity protocols such as Bluetooth, wireless local area network (WLAN) connectivity (such as IEEE 802.11 WiFi). Examples of other protocols include cellular digital packet data (CDPD), general packet radio service (GPRS), enhanced data rates for GSM evolution (EDGE), universal mobile telecommunications system (UMTS), one times radio transmission technology (1×RTT), evaluation data optimized (EVDO), high-speed downlink packet access (HSDPA), etc. The modem(s)/RF transceiver(s) 1372 are connected to the RF input 242 feed terminal of the antennae, as well as to the ground (e.g., metal frame 252) connected to the ground connections 244 of the antennae.

In the various examples, the monopole 220, is driven by the single RF input 242 to one resonant mode. However, an RF-fed structure that supports multiple resonant modes may be used instead, with at least one of the RF-fed resonance modes coupling to the T-monopole 230, 330, 730, 830 and/or the radiating element 160, 760. Moreover, one resonant mode of the RF-fed structure may couple to the T-monopole, while a different resonant mode of the RF-fed structure may couple to the radiating element. Also, instead of using a monopole fed from one end as the RF-fed element, another structure may instead be used, such as a loop structure, where one end of the loop structure connects to the RF input 242 and another end of the loop structure connects to ground 244. Even if a different RF-fed element is used, the principles of operation remain the same, with one or more resonant modes in the RF-fed structure parasitically coupling to the T-monopole 230, 330, 730, 830 and/or the radiating element 160, 760.

The antennae 110, 210, 310, 710, 810 may be constructed from one or more flat metal conductors. The conductors may be cut or etched from metal sheeting in the conventional manner, deposited or plated onto the substrate, etched from cladding layers formed on one or both sides of the substrate, or activated from metal-plastic additives included in the substrate. If metal sheeting is used, it may be standard sheeting commonly used for existing mobile device antennae, such as sheeting having a thickness of around 10 to 20 microns, although different thickness material may be used. Similar thickness may be used if the antenna is formed by other methods.

Among other antenna fabrications methods, laser direct structuring (LDS) may be used. The LDS process uses a thermoplastic material, doped with a metal additive activated by means of laser. The substrate may be single-component injection molded and can be used to create complex antenna and circuit layouts on a three-dimensional carrier structure. A laser writes the course of the antenna and circuit traces on the plastic. Where the laser beam hits the plastic, the metal additive forms a micro-rough track. The metal particles of this track form the nuclei for subsequent metallization. Placed in an electroless copper bath, the conductor path layers arise precisely on these tracks. Successively layers of copper, nickel, gold, tin, etc., may be raised in this way.

The UE 1300 may be configured to support a variety of wireless applications, such as the wireless downloading of media via the antennae and modem(s)/transceivers(s) 1372, the storage of the downloaded media in memory 1306 and/or storage 1306, and the playback of the media by controller(s)/processor(s) 1304. Examples of downloaded media include electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multimedia content. The UE 1300 may also be likewise configured to support interactive wireless applications, such as telephony and instant messaging.

The figures include "left," "right" and "upper," which are used for ease of description based on the perspective of the illustrations. While the direction and orientation of the various elements of the antennae to each other may be relevant to antenna operation, the left-right, up-down orientation of the antennae as a whole is solely a matter of perspective.

As noted above in the discussion of substrates, the antennae described herein may be implemented with two-dimensional geometries, as well as three-dimensional geometries. Also, the frequency bands used in the example antennae are included for the purpose of demonstration, and by changing the dimensions of the various elements, different bands may be supported. Also, resonant elements may be emitted if fewer bands are needed, or additional resonant elements may be added (added to either the RF-fed antenna, the T-monopole antenna, or the opposing radiating element).

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art.

As used in this disclosure, the term "a" or "one" may include one or more items unless specifically stated otherwise.

What is claimed is:

1. A multi-band antenna structure, comprising:

a single radio frequency (RF) input;

a three-dimensional substrate having:

a first surface, an opposing second surface, the first and second surfaces separated by a thickness of the substrate, and a third surface across the thickness of the substrate;

a first antenna element comprising a monopole arranged on the first surface of the substrate and connected to the single RF input, wherein the first antenna element is configured to transmit at a first center frequency;

a second antenna element arranged on the second surface of the substrate, the second antenna element parasitically coupled to the first antenna element so that a physical proximity of the first and second antenna elements causes electric field emissions of the first antenna element to generate an electric field in the second antenna element, wherein the second antenna element is configured to transmit at a second center frequency, the second center frequency being different than the first center frequency; and a third antenna element comprising a T-monopole arranged on the first surface of the substrate and parasitically coupled to the first antenna element so that a physical proximity of the first and third antenna elements causes electric field emissions of the first antenna element to generate an electric field in the third antenna element, the T-monopole comprising:

a base connected to ground, and a first arm and a second arm extending out from a distal end of the base, wherein the distal end of the base is opposite an end of the base connected to ground, and wherein the first arm extends away from the base in a first direction and the second arm extends away from the base in a second direction opposite from the first direction;

wherein:

the third antenna element is configured to transmit at a plurality of center frequencies, each of the plurality of center frequencies being different from each other, and different from the first and second center frequencies, and there is no physical electrically conductive connection between the first and third antenna elements.

2. The multi-band antenna structure of claim 1, wherein the second antenna element has no physical electrically conductive connection to either the first or third antenna elements, and wherein a length of the second antenna element is approximately equal to one-half of a wavelength of the second center frequency.

3. The multi-band antenna structure of claim 1, wherein the second antenna element has no physical electrically conductive connection to the first antenna element, and has a physical electrically conductive connection to the third antenna element along the third surface of the substrate near a junction of the first arm and the second arm at the distal end of the base near where the first arm and the second arm extend from the base, and wherein a length of the second antenna element is approximately equal to one-quarter of a wavelength of the second center frequency.

4. The multi-band antenna structure of claim 1, further comprising a conductive stub having one end connected to ground and no connection at another end, wherein the conductive stub is interposed between the first antenna element and a first arm of the third antenna element, one side of the conductive stub being adjacent to and in parallel with a length of a portion of the first antenna element and at least a portion of an opposite second side of the conductive stub being adjacent to a portion of the first arm of the third antenna element.

5. The multi-band antenna structure of claim 1, wherein:

the second antenna element comprises a first portion and a second portion, the first portion opposing a portion of the first antenna, and the second portion opposing a portion of the T-monopole, and the second center frequency is different than all the center frequencies of the first and third antenna elements.

6. A wireless communication device comprising:

a radio transceiver;

a processor communicatively coupled to the radio transceiver;

an antenna comprising:

a radio frequency (RF) input, coupled to the radio transceiver;

a substrate having a first surface and an opposing second surface, the first and second surfaces separated by a thickness of the substrate;

a first antenna element arranged on a first surface of the substrate and connected to the RF input, wherein the first antenna element is configured to provide a first resonant mode with a first center frequency;

a second antenna element arranged on the second surface of the substrate, wherein the second antenna element is configured to provide a second resonant mode with a second center frequency and is parasitically coupled to the first antenna element, the second center frequency being different than the first center frequency; and a third antenna element arranged on the first surface of the substrate and parasitically coupled to the first antenna element, wherein the third antenna element is configured to provide a plurality of resonant modes, each of the plurality of resonant modes having a different center frequency, and having a center frequency different from the first and second center frequencies.

7. The wireless communication device of claim 6, wherein the second center frequency is within a range of 2.5 to 2.7 GHz.

8. The wireless communication device of claim 6, wherein the second antenna element has no physical electrical connection to either the first or third antenna elements, and wherein a length of the second antenna element is approximately equal to one-half of a wavelength of the second center frequency.

9. The wireless communication device of claim 6, wherein the second antenna element has no physical electrically conductive connection to the first antenna element, and has a physical electrically conductive connection to the third antenna element across the thickness of the substrate, and wherein a length of the second antenna element is approximately equal to one-quarter of a wavelength of the second center frequency.

10. The wireless communication device of claim 6, wherein the third antenna element is a T-monopole, the T-monopole comprising:

a base connected to ground; and a first arm and a second arm extending out from a distal end of the base , wherein the distal end of the base is opposite an end of the base connected to ground, wherein the first arm extends away from the base in a first direction and the second arm extends away from the base in a second direction opposite from the first direction.

11. The wireless communication device of claim 10, further comprising a conductive stub having one end connected to ground and no connection at another end, wherein the conductive stub is interposed between the first antenna element and a first arm of the third antenna element, one side of the conductive stub being adjacent to and parallel with a length of a portion of the first antenna element and at least a portion of an opposite second side of the conductive stub being adjacent to a portion of the first arm of the third antenna element.

12. The wireless communication device of claim 10, wherein the first antenna element is a monopole, connected at one end to the RF input.

13. The wireless communication device of claim 10, wherein the second arm of the T-monopole includes a folded portion that extends back toward the base.

14. The wireless communication device of claim 6, wherein:

the first surface of the substrate is non-planar and comprises at least two levels and a step between the at least two levels, and the third antenna element is non-planar, arranged on at least two of the at least two levels.

15. The wireless communication device of claim 6, wherein the second center frequency is different than all of the center frequencies of the first antenna element and the third antenna element.

16. An antenna structure comprising:

a radio frequency (RF) input;

a substrate having a first surface and an opposing second surface, the first and second surfaces separated by a thickness of the substrate;

a first antenna element arranged on a first surface of the substrate and connected to the RF input, wherein the first antenna element is configured to provide a first resonant mode with a first center frequency;

a second antenna element arranged on the second surface of the substrate, wherein the second antenna element is configured to provide a second resonant mode with a second center frequency and is parasitically coupled to the first antenna element, the second center frequency being different than the first center frequency; and a third antenna element arranged on the first surface of the substrate and parasitically coupled to the first antenna element, wherein the third antenna element is configured to provide a plurality of resonant modes, each of the plurality of resonant modes having a different center frequency, and having a center frequency different from the first and second center frequencies.

17. The antenna structure of claim 16, wherein the second center frequency is within a range of 2.5 to 2.7 GHz.

18. The antenna structure of claim 16, wherein the second antenna element has no physical electrically conductive connection to either the first or third antenna elements, and wherein a length of the second antenna element is approximately equal to one-half of a wavelength of the second center frequency.

19. The antenna structure of claim 16, wherein the second antenna element has no physical electrically conductive connection to the first antenna element, and has a physical electrically conductive connection to the third antenna element across the thickness of the substrate, and wherein a length of the second antenna element is approximately equal to one-quarter of a wavelength of the second center frequency.

20. The antenna structure of claim 16, wherein the third antenna element is a T-monopole, the T-monopole comprising:

a base to be connected to ground; and a first arm and a second arm extending out from a distal end of the base that is opposite an end of the base to be connected to ground, wherein the first arm extends away from the base in a first direction and the second arm extends away from the base in a second direction opposite from the first direction.

21. The antenna structure of claim 20, further comprising a conductive stub having one end to be connected to ground and no connection at another end, wherein the conductive stub is interposed between the first antenna element and a first arm of the third antenna element, one side of the conductive stub being adjacent to and parallel with a length of a portion of the first antenna element and at least a portion of an opposite second side of the conductive stub being adjacent to a portion of the first arm of the third antenna element.

22. The antenna structure of claim 20, wherein the first antenna element is a monopole, connected at one end to the RF input.

23. The antenna structure of claim 20, wherein the second arm of the T-monopole includes a folded portion that extends back toward the base.

24. The antenna structure of claim 16, wherein:

the first surface of the substrate is non-planar and comprises at least two levels and a step between the at least two levels, and the third antenna element is non-planar, arranged on at least two of the at least two levels.

25. The antenna structure of claim 16, wherein the second center frequency is different than all of the center frequencies of the first antenna element and the third antenna element.

* * * * *